United States Patent [19]

Hager et al.

[11] Patent Number: 5,027,485

[45] Date of Patent: Jul. 2, 1991

[54] SECTIONAL WARPING MACHINE WITH A HEIGHT ADJUSTABLE CROSS REED FOR THE FORMATION OF YARN CROSSINGS AND METHODS OF ITS OPERATION

[75] Inventors: Hans-Jürgen Hager, Oberuzwil; Antonio Häne, Uzwil; Jakob Iten, Oberuzwil; Gerhard Koslowski, Uzwil, all of Switzerland

[73] Assignee: Benninger AG, Uzwil, Switzerland

[21] Appl. No.: 536,782

[22] Filed: Jun. 12, 1990

[30] Foreign Application Priority Data

Jun. 14, 1989 [CH] Switzerland ..... 2220/89

[51] Int. Cl.[5] ..... D02H 13/26

[52] U.S. Cl. ..... 28/191; 28/194; 28/199

[58] Field of Search ..... 28/181, 191–194, 28/196–198, 199, 202

[56] References Cited

U.S. PATENT DOCUMENTS

| | | | |
|---|---|---|---|
| 1,321,631 | 11/1919 | Hellawell | 28/191 |
| 2,756,481 | 7/1956 | Bauer | 28/194 |
| 2,797,468 | 7/1957 | Brown | 28/194 |
| 2,938,259 | 5/1960 | Stöck | 28/199 |
| 4,074,404 | 2/1978 | Schenk | 28/191 X |
| 4,765,041 | 8/1988 | Bahzer | 28/191 |
| 4,819,310 | 4/1989 | Beerli et al. | 28/191 X |

FOREIGN PATENT DOCUMENTS

| | | | |
|---|---|---|---|
| 2544445 | 2/1977 | Fed. Rep. of Germany . | |
| 1273799 | 9/1961 | France | 28/191 |
| 278537 | 1/1952 | Switzerland | 28/199 |

*Primary Examiner*—Werner H. Schroeder
*Assistant Examiner*—John J. Calvert
*Attorney, Agent, or Firm*—Shoemaker and Mattare, Ltd.

[57] ABSTRACT

The yarn crossing device of a sectional warping machine has a height adjustable cross reed (16), two guide rods (28, 29) which are able to slide in opposition to each other, as well as a horizontally displaceable leasing device (34, 35). Drive motors (22, 33), which are independent from one another and separately controllable, are allocated at least to the cross reed (16) and to the guide rods (28, 29). Preferably a separate drive motor (38) for the leasing device and a cross-wound motor (17) for the oscillating motion of the cross reed (16) is also provided. The independent drive motors make possible automation and programming of the different operational sequences which are necessary for the formation of yarn crossings or the rectification of breakages.

16 Claims, 5 Drawing Sheets

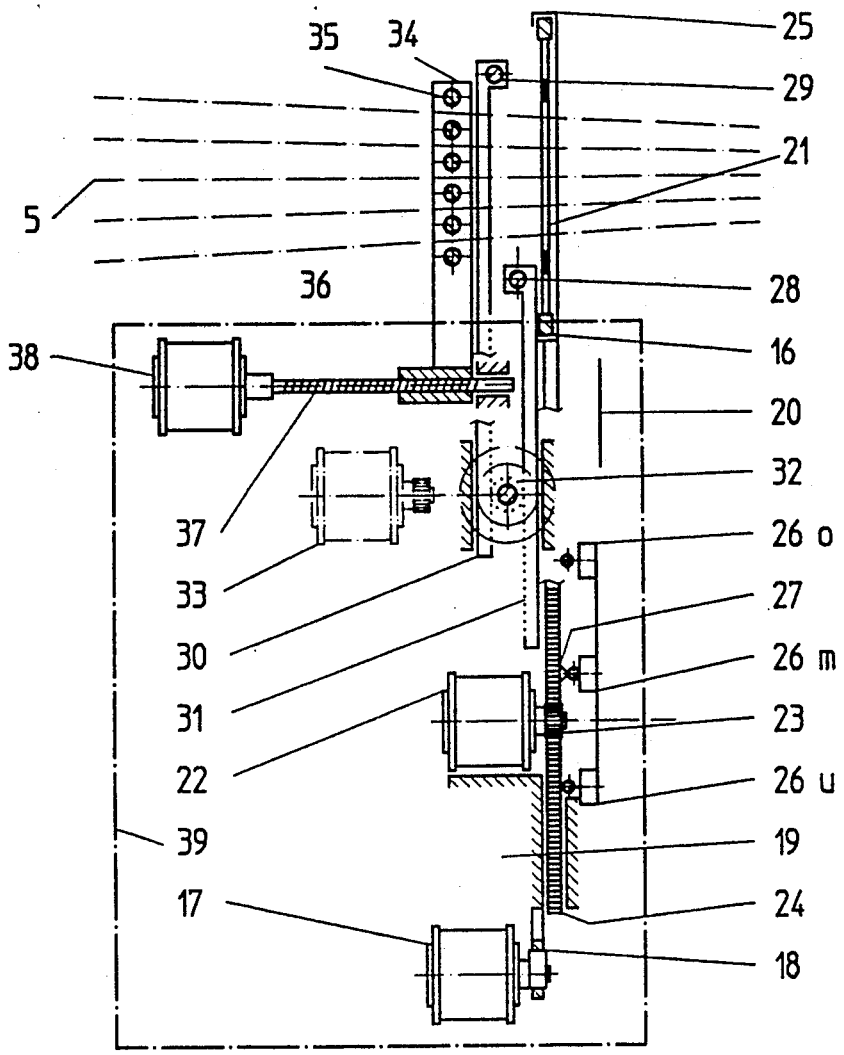
Fig.2
Fig.7
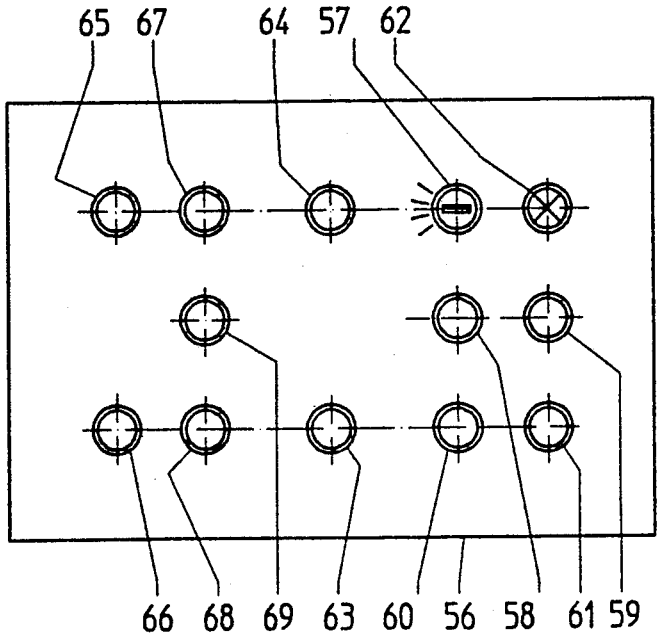

SECTIONAL WARPING MACHINE WITH A HEIGHT ADJUSTABLE CROSS REED FOR THE FORMATION OF YARN CROSSINGS AND METHODS OF ITS OPERATION

BACKGROUND OF THE INVENTION

1. Field of the Invention

The invention concerns a sectional warping machine with a height adjustable cross reed for the formation of yarn crossings. The invention further concerns a method of operation of a machine of this type.

2. Description of the Prior Art

It has already been acknowledged for a long time that, for the formation of yarn crossings, the yarn warp is held in the region of the cross reed with the aid of guide rods in principle in a common plane. Through upwards or downwards displacement of the cross reed, individual yarns can at the same time be disengaged from this plane, whereby a shed is formed for the insertion of a leasing element. This kind of device is, for example described in DE-C-25 44 445. Also in the case of yarn breakage, it is appropriate if the yarn warp is brought together at a common level, not only because the breakage point is more easily recognisable, but also because it is more accessible for the necessary repair work. This position for the re-threading of broken yarns is depicted, for example, in CH-A-370 363.

The producing of a yarn crossing is, with conventional devices, undertaken manually by the operator in individual steps. This is not only very time consuming, but it requires a high level of concentration since the most varied yarn crossings can be formed with the same device in the most varied sequences. Manipulation errors can therefore easily occur, which can later cause considerable problems in the creation of warps. Recently, the insertion of a leasing element for the formation of a yarn crossing has been automated, which increases the risk of manipulation errors if the operator must actuate the cross reed and/or the guide rods manually.

SUMMARY OF THE INVENTION

It is therefore a purpose of the invention to create a sectional warping machine of the type mentioned in the introduction which makes a high degree of automation possible, and with which the numerous working positions, which become necessary during the course of the working procedure, can be automatically assumed. The operator shall at the same time have his work load reduced, in that a certain movement sequence proceeds, controlled by a motor, without the need for manual intervention so that manipulation errors can be extensively avoided.

This task is achieved according to the invention with a sectional warping machine described below. The independent motorisation of the machine parts to be put into motion makes a programmed control for each required working step possible, whereby the operator can limit himself to monitoring duties and the actuation of the individual automated working steps.

Both the guide rods are preferably synchronously moveable towards and away from each other by means of a transmission. This ensures that the yarn sheet can be constricted from above and below to the same degree.

The cross reed can be displaceable by means of a transmission out of a middle position relative to the guide rods into at least a lower and an upper yarn crossing position. Naturally, intermediate positions are conceivable if these are required in individual cases. The motorisation ensues in an especially simple way if limit switches are provided on the transmission, by means of which the drive motor is controllable for travel to the three working positions.

Further advantages can be aimed at if a leasing device, for the division of the yarn warp into individual groups, is arranged in front of the guide rods in the direction in which the yarns pass through, which is displaceable by means of independent and separate controllable drive motors towards or away from the cross reed. The conventional leasing device normally has the task of grouping the yarn warp according to the number of tiers on the bobbin creel. The leasing device can, for example, comprise horizontal lease rods which are fixed to a lease rod holder. In the place of lease rods, a thread guide carrier would also be conceivable, by which each separate yarn is guided. Particularly in the case of a yarn breakage, it is important, for unobstructed accessibility, that the leasing device is able to be distanced from the cross reed. But displacement can also be appropriate when threading in the yarns. Once again, the separate drive of the leasing device enables it to be displaced in varied independence from the other working steps.

The leasing device can, for example, be displaceable by means of a transmission which possesses a fixed position rotatable spindle engaged with a spindle bush, on which is fixed the leasing device. However, other drive methods are conceivable, such as, for example, racks, sheathed cable etc.

Damage to the yarns in the cross reed can be avoided if the cross reed and the motor allocated to it are arranged in a frame, which, independent from the working position of the cross reed, is able to be set into an oscillating motion by means of an independent and separate controllable drive motor. Consequently, the cross reed can be moved into a yarn crossing position during the back and forth movement. On the other hand, however, the oscillating movement can also only be engaged if the cross reed is situated in the normal running position and if the warping drum is running at its normal speed. The back and forth movement can, for example, ensue by means of a rotary drive through an eccentric transmission. An electromagneticly produced oscillation, without a transmission, would also be conceivable.

For the reduction of the risk of accidents all drive motors can be equipped with load controlled friction clutches or other safety elements, which bring the drive motors to rest or limit their transmitted power.

Numerous operating possibilities result if at least the drive motors, for the cross reed and for the lease rods, are controllable by means of a programmable common control device. Preferably all drive motors mentioned up to now are controllable with one common control device, which makes possible an optimum number of possibilities for programming and different switching functions. The mentioned control device is also preferably coordinated with a main control device for controlling the sectional warping machine. The important functions of the sectional warping machine such as, for example, winding speed, tension, lateral feed etc. are nowadays controlled without problems by means of a central computer. The linking of the control functions for the cross reed and the lease rods with those of the central computer presents a further step towards full automation of the sectional warping process. According to the type of machine, the control device for the different drive motors is conveniently integrated directly with the main control device.

The invention also concerns a method of drive of the sectional warping machine mentioned in the introduction. This is characterised in that, on the return travel of the cross reed from its yarn crossing position into a neutral running position, the warping drum is rotated in such a way that the yarns remain under tension. On the other hand the return speed of the cross reed can also be so selected that, at a preselected creep motion of the warping drum, the yarns remain tensioned during the whole return movement.

When the cross reed is extended into a yarn crossing position, the yarn distance of the individual yarns between the yarn bobbins on the bobbin creel and the warping drum enlarges. This additional yarn length is unwound on the bobbin creel. When the cross reed is returned into the neutral position this over-length remain, which would lead in consequence to sagging of the yarns. According to the invention, this sagging can be avoided as a result of the coordination between the winding speed and the return movement of the cross reed.

BRIEF DESCRIPTION OF THE DRAWINGS

Further advantages and individual characteristics of the invention are set out in the following description of an embodiment of the invention, and the associated drawings therein:

FIG. 2 is a side elevation of a yarn crossing device with its drive elements, FIG. 7 is a front view of the operating panel for a control device.

DESCRIPTION OF THE PREFERRED EMBODIMENT

Figure 1:
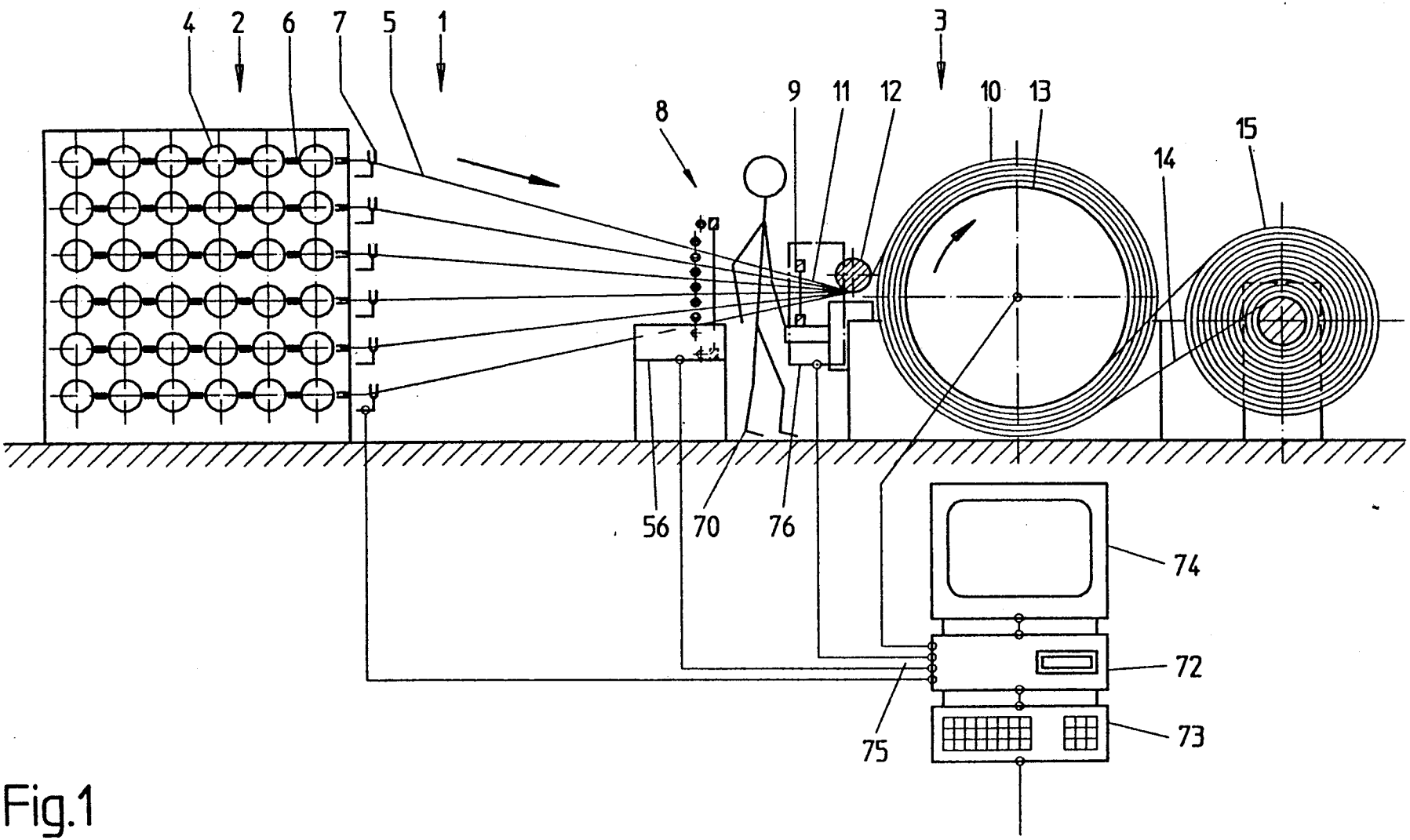
FIG. 1 is a sectional warping plant viewed from the side in very simplified form.

FIG. 1 shows a side view of a sectional warping plant 1, comprising a bobbin creel 2 and a section warping machine 3. Here the yarns 5 are unwound in a conventional way from the mounted bobbins 4 and led over yarn tensioners 6 and thread monitors 7 of the section warping machine 3. The yarns next pass the yarn crossing device 8 before they acquire, by means of the guide reed 9, the necessary warp strip width of the yarns to be wound up, and thence are wound up as a yarn strip 11 over the deflection roll 12 onto the warping drum 13.

In a likewise conventional way, numerous strips 10 make up the warp 14, whereby subsequently all strips 10, combined, are rewound or beamed onto the warping beam 15. The warping beam will follow on to the weaving machine for the manufacture of the fabric.

In order that the established yarn sequence of a pattern repeat is maintained in the warp until insertion into the weaving machine, it is conventionally necessary to produce the so called yarn crossings, especially at the start and at the end of each strip 10. Yarn crossings are also required in connection with size treatment, whereby the expression "Sizing division" is used. These yarn crossings are produced in the yarn crossing device 8, the principle components of which are more exactly depicted in FIG. 2.

As is already known, the yarn crossing device comprises in principle a height adjustable cross reed 16 and the guide rods 28 and 29 arranged in front of it. Numerous parallel vertically displaced lease rods 35 are arranged in front of the guide rods, which can be moved towards one another, and which are held at the sides by a pair of lease rod holders 34.

The cross reed 16 is connected to a rack 24 which engages with the pinion 23 of a lifting motor 22. The lifting motor is fixed in a frame 19 and, according to its direction of drive, the cross reed can be raised in the direction of the arrow 20 either upwards or downwards. The lifting motor 22 receives switching signals from the limit switches 26, which are arranged in the region of the transmission. A cam 27 is arranged on the rack 19 for actuation of the limit switches 27. With that, the limit switches 26*o* and 26*u* each define an upper and a lower yarn crossing position, whilst the middle limit switch 26*m* defines a middle position.

The frame 19 is mounted in bearings to slide in the plane of the cross reed 16 and can, by means of a cross-wound motor and an eccentric drive 18, be set into an continuous oscillating motion in the direction of arrow 20. Cutting of the teeth 21 of the cross reed 16 into the yarns 5 can be avoided in this way. Naturally, the frame 25 of the cross reed can be displaced independently from the actuation of the cross-wound motor 17.

An upper and a lower guide rod 28 and 29 is arranged in front of the cross reed 16, whereby each is connected to a rack 30 and 31. The teeth of these racks are set in opposition to each other, and mounted in bearings to slide parallel to each other. Both racks engage with the pinion 32 of a yarn sheet motor 33, so that the guide rods 28 and 29 are able to move synchronously towards and away from one another. In order to define both the end positions for the guide rods 28, 29, limit switches could be likewise arranged on the racks.

A lease rod holder 34 with horizontal lease rods 35 is arranged in front of the guide rods 28 and 29. These divide the warp sheet coming from the bobbin creel, as a rule corresponding to the number of tiers, before it is led to the cross reed 16. The lease rod holder is fixed to a spindle bush 36 which locates on a threaded spindle which is mounted on bearings in a fixed position. The threaded spindle 37 is driven by the lease rod motor 38, so that the spindle bush 36, and with that the guide rod holder 34, is able to be displaced towards and away from the cross reed.

All drive motors 17, 22, 33 and 38, as well as their transmission elements, are elegantly dust-protected and safely enclosed in a housing 39 and arranged beneath the yarn crossing device 8. This separation of the drive motors, as depicted in FIG. 2, permits now a multitude of control possibilities, which are more exactly explained in the following. The individual drive motors are at the same time controllable by means of a common control device 56 which is not depicted in more detail here.

Figure 3A:
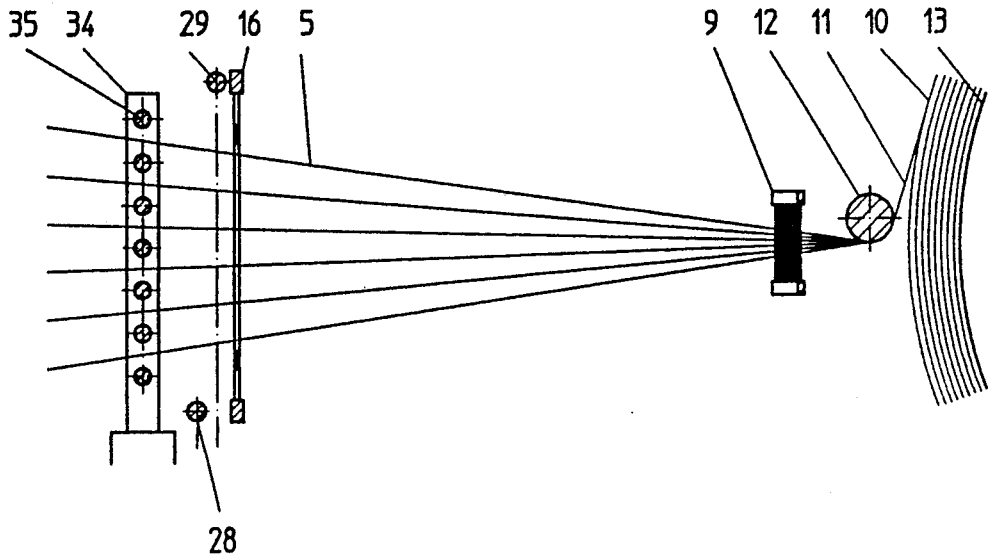
FIG. 3*a* shows the yarn crossing device according to FIG. 2 in the running position.

In FIG. 3*a*, the relative position of the individual machine elements of the yarn crossing device 8 are depicted in their normal running position, in which the warping drum 13 winds up the already mentioned strip 10 over a deflection roll 12. The cross reed assumes at the same time a middle position in relation to the two guide rods 28, 29, and, by means of the cross-wound motor 17, continuously moved up and down without, however, at the same time affecting the yarn sheet 5 in any way. Both the guide rods 28 and 29 are fully opened and likewise do not touch the yarn sheet 5.

The lease rod holder 34, with the lease rods 35, is brought near the cross reed and the guide rods and divides up the yarn sheet in the way already described.

Figure 3B:
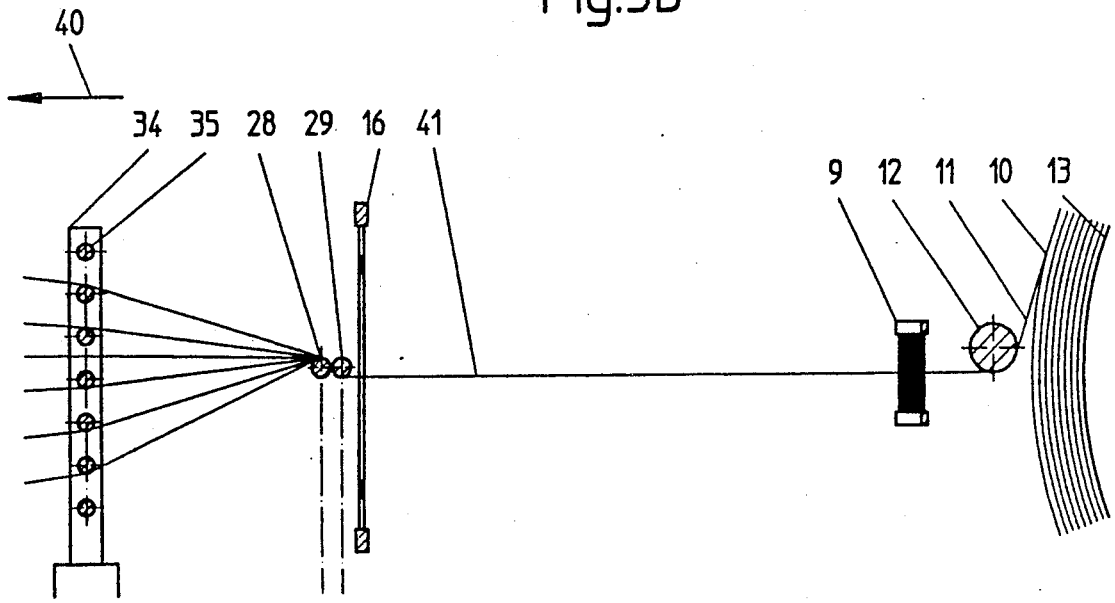
FIG. 3*b* shows the yarn crossing device according to FIG. 2 in the repair position when a yarn breakage is being rectified.

If, for example, a yarn breakage is detected by a thread monitor 7 in one of the tiers, the sectional warping machine will stop in the conventional way whereby, however, the elements of the yarn crossing device will at the same time automatically assume the position shown in FIG. 3*b*. The lease rod holder 34 is distanced from the cross reed 16 through activation of the lease rod motor 38 in the direction of the arrow 40. Simultaneously the yarn sheet motor 33 is actuated, so that the guide rods 28 and 29 are moved towards each other until they lie in approximately the same plane. This naturally causes an even yarn strip 41 to be formed between the guide rods 28/29 and the deflection roll 12. This flat yarn strip 41 now permits the operator to recognise immediately the position of a yarn breakage and to rectify this correctly with regard to its position. The cross reed 16 retains its neutral middle position, whereby however the cross-wound motor 17 can be likewise be made inactive while the machine is at rest.

Figure 4A:
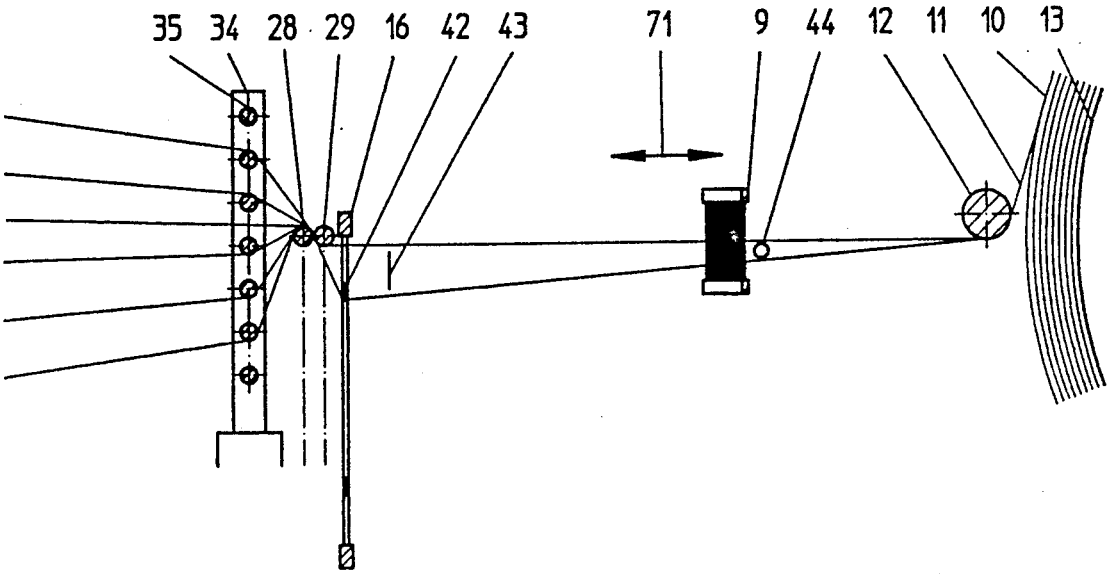
FIG. 4*a* shows the yarn crossing device according to FIG. 2 in a lower yarn crossing position.
Figure 4B:
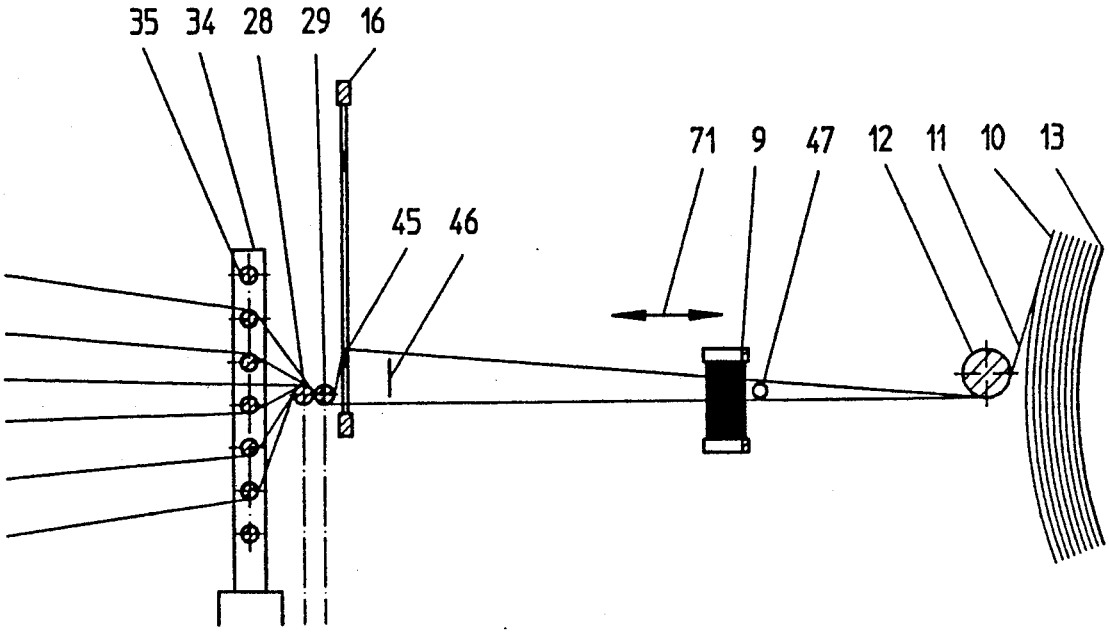
FIG. 4*b* shows the yarn crossing device according to FIG. 2 in an upper yarn crossing position.

The formation of the yarn crossings is explained in the following with the aid of FIGS. 4*a* and 4*b*. For the formation of the first yarn crossing the guide rods 28 and 29 are once again brought together in a similar way to the repair position according to 3*b*. The lease rod holder 34 remains however in the engaged position which it occupies in the running position according to FIG. 3*a*. Subsequently, by means of the lifting motor 22, the cross reed 16 is lowered into the lower yarn crossing position. With that each odd yarn, for example, is disengaged from the horizontal yarn strip 41 by means of the soldered points 41, whilst the even yarns remain unaffected. Naturally, through the lowering of the cross reed a shed 43 is opened up, in which the first cross cord 44 can be inserted. In order to fully exploit the height of the shed, at the same time the guide reed 9 is preferably automatically transported towards the cross reed before insertion of the cross cord and subsequently returned to its original position, as indicated by the horizontal arrow 71. The insertion of the cross cord or another means of division can, apart from that, ensue by means of an automatic device which is not depicted here, which engages into the shed 43 from the side.

In order to insert the second cross cord 47 the sectional warping machine 3, or the warping drum 13, is moved further for a certain distance. Subsequently the cross reed 16 is brought into the upper yarn crossing position according to FIG. 4*b*, whilst the guide rods 28 and 29 maintain their proximity. In the same way, the second cross cord can be inserted into the shed 46 which has been formed in this way.

Figure 5:
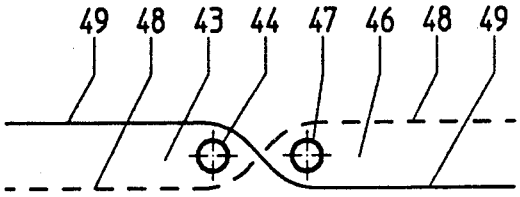
FIG. 5 depicts the construction of a yarn crossing.
Figure 6A:
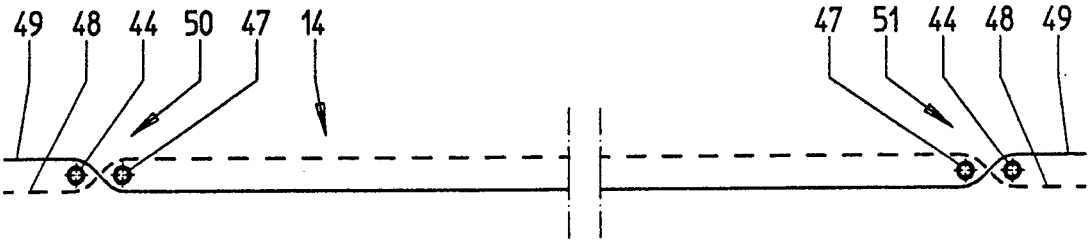
FIG. 6*a* shows a warp with a start crossing and with an end crossing.
Figure 6B:
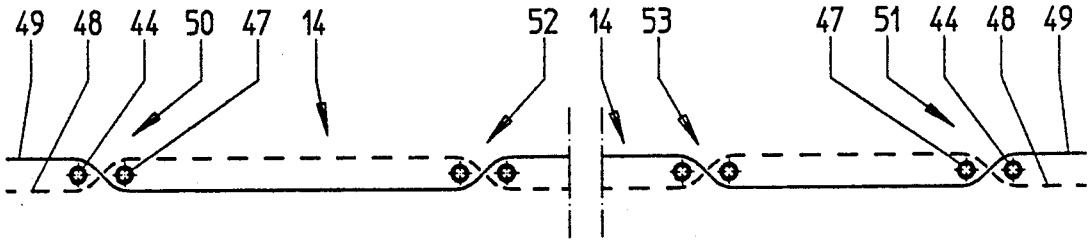
FIG. 6*b* shows a warp with two additional middle crossings.
Figure 6C:
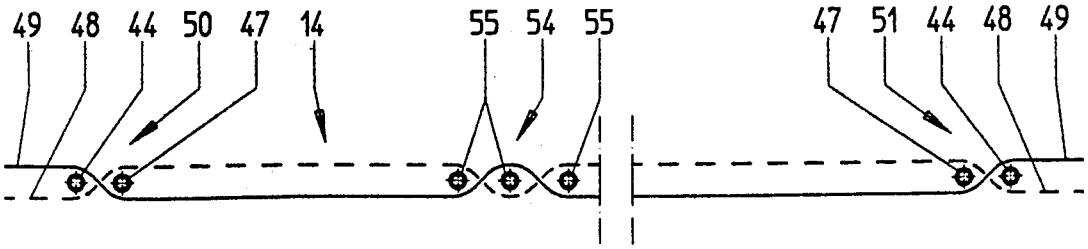
FIG. 6*c* shows a warp with an additional triple middle crossing.

Naturally, different combinations of yarn crossings can be produced according to the type of operation of the machine, as can be seen in FIGS. 5 and 6*a* to 6*b*. The procedure explained according to 4*a* and 4*b* leads to a simple yarn crossing, as is illustrated in FIG. 5. In FIG. 6*a* a warp 14 is depicted which possesses a start yarn crossing 50 comprising two cross cords 44 and 47 as well as an end yarn crossing 51, likewise comprising two cross cords 44 and 47. According to requirements, additional yarn crossings 52 and 53 can be made within the warp for better yarn division, as can be deduced from FIG. 6*b*. As a rule, the start crossing 50 and the end crossing 51 always remain the same, whilst different variations are conceivable in between. FIG. 6*c*, for example, shows a triple yarn crossing 54, comprising three cross cords 55, instead of the normal intermediate crossings. The disengaged yarns according to FIG. 4*a* and 4*b* naturally reach over a longer distance than the other yarns which remain in the horizontal yarn strip. The warping drum 13 is thus placed under tension at the return travel of the cross reed 16 into the middle position or when changing from one yarn crossing position to another, so that drooping of the yarns cannot occur. Since the creation of yarn crossings is also possible, without problems, with the sectional warping machine 3 in creep motion, the displacement speed of the cross reed 16 is preferably adjusted to the creep speed, so that drooping of individual yarns is at no time possible.

The control device 56, depicted in FIG. 1 for the different motors, is preferably coordinated with the computer 72, which serves as the main control device for the entire plant. The warping data can be entered into this computer through an imput station 73, whereby at the same time the necessary yarn crossings can be pre-programmed. The screen 74 facilitates the communication between Man and Machine, and apart from that serves as an operator guide, in which the operator 70 receives instructions from the screen 74. The computer is coordinated with the thread monitors 7 on the bobbin creel 2 through the connection cables 75, as well as with the automatics 76 for introducing the cross cords, which are not more closely depicted here.

The control device 56 can possess an operating panel which, for example, is depicted in FIG. 7. Different switching devices are arranged on the operating panel, which the control procedures can be triggered. A keyed switch secures the control device and makes possible the preselection of different types of operation. The programming switches 58 to 61 and, if required, further programming switches, likewise permit the actuation of different functions. Thus, for example, the upper yarn crossing position of the cross reed can be assumed with the push button 58, and the lower with the push button 59. The cross lay, according to choice, can thus be begun by selection of a disengagement upwards or downwards, as is depicted in FIG. 4*a* and 4*b*. Through depression of the push button 60, a program ensues for the insertion of two cross cords, and by depressing the push button 61, a program ensues to insert three cross cords.

The program switches 58 to 61 are formed as illuminated push buttons, and the selected functions will flash during the running of the input programs. The lamp 62 signals commencement and duration of the crosslay sequence. The illuminated push button 63 signals the automatic crosslay sequence. With the stop button 64, the automatic crosslay sequence can be interrupted at any time. Through depressing the illuminated push button 65 the system exits the automatic control sequence and it becomes possible, once again, to actuate the lease rod holder, the cross reed and the guide rods individually, and also in the desired order.

The separately controllable motors of the yarn crossing device provide many different combination possibilities in free manual operation with any movement sequence or, in automatic operation, with a dependent movement sequence. A sensible movement sequence would be, for example, that the cross reed functions would be blocked at normal production speeds.

The different programming possibilities of the leasing device, the guide rods and the cross reed are apparent on the following table. With that, a cross-wound motor could be included without further ado, which would be appropriately only activated in the running position acording to FIG. 3*a*. The displacement of the guide reed 9 in the direction of the arrow 71, with its own drive motor, which is not depicted here, could still be integrated into the automatic movement procedure.

| | Leasing device | Guide rods | Cross reed |
|---|---|---|---|
| Running position | positioned at cross reed | open | Middle position |
| Lower yarn crossing position | positioned at cross reed | closed | below |
| Upper yarn crossing position | positioned at cross reed | closed | above |
| Repair position | distanced from cross reed | closed | Middle position |

We claim:

1. A sectional warping machine comprising:

a height adjustable cross reed for the formation of yarn crossings; and two guide rods located in front of the cross reed in the direction of a yarn warp passing through said cross Reed, one of the rods is arranged above and the other rod below the yarn warp and both are able to be moved towards each other to bring the yarn warp together into one plane, and independent, separately controllable drive motors are connected respectively to the cross reed and to both the guide rods.

2. A sectional warping machine according to claim 1, further comprising a transmission for moving both the guide rods synchronously towards and away from each other.

3. A sectional warping machine according to claims 1 or 2, further comprising a transmission for moving the cross reed relative to the guide rods from a middle position into a lower and into an upper yarn crossing position.

4. A sectional warping machine according to claim 3, further comprising limit switches arranged on the transmission for controlling the cross reed drive motor for travel into the three working positions.

5. A sectional warping machine according to claim 1, further comprising a leasing device, displaceable through an independent and separately controlled motor both towards and away from the cross reed for dividing the yarn warp into individual groups, arranged in front of the guide rods in the direction of passage of the yarn warp.

6. A sectional warping machine according to claim 5, the leasing device further comprising a transmission for displacing said transmission having a fixed-position threaded spindle, journalled in bearings, which locates in a spindle bush onto which the dividing device is fixed.

7. A sectional warping machine according to claim 1, further comprising a frame supporting the cross reed and the cross reed motor, and means comprising an independent and separately controllable drive motor independent from the working position of the cross reed for oscillating said frame.

8. A sectional warping machine according to claim 7, wherein the frame is mounted in bearings to slide in the plane of the cross reed and is connected with the frame oscillating drive motor through an eccentric transmission.

9. A sectional warping machine according to claim 1, wherein the drive motors for the cross reed and for the guide rods are controllable by a common, programmable control device.

10. A sectional warping machine according to claim 9, wherein the common control device is coordinated with a main control device for controlling the sectional warping machine.

11. A sectional warping machine according to claim 9, wherein the common control device is integrated into a main control device.

12. A sectional warping machine according to one of claims 9, 10, or 11, wherein the control device is coordinated with yarn thread monitors which are allocated to each yarn.

13. A sectional warping machine according to claim 9, wherein the control device includes switch elements for setting preselectable working positions of the cross reed and the guide rods.

14. A sectional warping machine according to claim 13, wherein the control device is coordinated with a screen, displaying information concerning the working position of the cross reed and the guide rods.

15. A method of driving a sectional warping machine with a height adjustable cross reed for formation of yarn crossings in a yarn warp and with two guide rods arranged in front of the cross reed in the direction of passage of the yarn warp, one of the Rods above and the other Rod below the yarn warp, and where each of the Rods is movable in one plane towards each other in order to bring the yarn warp together, the improvement comprising a step of rotating a warping drum so that the yarns remain in tension when returning the cross reed from a yarn crossing position into a neutral running position.

16. A method according to claim 15, wherein the return speed of the cross reed is selected so as to keep the yarn warp in tension throughout the whole return motion at a preselectable creep speed of the warping drum.

* * * * *